US010285505B2

(12) United States Patent
Summerville

(10) Patent No.: US 10,285,505 B2
(45) Date of Patent: May 14, 2019

(54) MODULAR FURNITURE

(71) Applicant: Regency Seating, Inc., Akron, OH (US)

(72) Inventor: John Summerville, Uniontown, OH (US)

(73) Assignee: Regency Seating, Inc., Akron, OH (US)

( * ) Notice: Subject to any disclaimer, the term of this patent is extended or adjusted under 35 U.S.C. 154(b) by 418 days.

(21) Appl. No.: 15/067,664

(22) Filed: Mar. 11, 2016

(65) Prior Publication Data

US 2017/0020295 A1 Jan. 26, 2017

Related U.S. Application Data

(60) Provisional application No. 62/131,893, filed on Mar. 12, 2015.

(51) Int. Cl.
*A47C 7/70* (2006.01)
*A47B 83/02* (2006.01)

(52) U.S. Cl.
CPC ..... *A47C 7/70* (2013.01); *A47B 83/02* (2013.01)

(58) Field of Classification Search
CPC ..... A47C 7/70; A47B 83/02
USPC ..... 297/171, 173, 188.14
See application file for complete search history.

(56) References Cited

U.S. PATENT DOCUMENTS 5,865,124 A 2/1999 Wroe
5,951,111 A * 9/1999 Klimenko ..... A47C 4/54 297/188.14
6,059,357 A * 5/2000 Peart ..... A47C 7/68 297/188.14
6,109,580 A 8/2000 Stern et al.
6,412,862 B1 * 7/2002 Dickerson ..... A47C 7/70 297/188.14 X
6,802,265 B1 10/2004 Dodson et al.
7,290,746 B1 11/2007 Macias et al.
2006/0144750 A1 7/2006 Dziaba et al.
2006/0170257 A1 8/2006 Marshall et al.
2007/0261981 A1 11/2007 Ojeda
(Continued)

FOREIGN PATENT DOCUMENTS

CN 202619003 12/2012
GB 238273 4/1924
(Continued)

*Primary Examiner* — Anthony D Barfield
(74) *Attorney, Agent, or Firm* — Edwin A. Sisson, Attorney at Law, LLC; Jeffrey J. Banyas

(57) ABSTRACT

Provided is a modular furniture apparatus comprising a chair, a first cup holder engaged with the chair, a first tablet, and a first engagement fixture. The first cup holder may define a substantially cylindrical first cavity having a substantially cylindrical first interior wall elongated along a first cylinder axis, the first interior wall bounded, by an inward-facing first bottom end wall, and by an open aperture opposite the first bottom end wall along the first cylinder axis. The first tablet may have a first tablet surface, and a second tablet surface opposite said first tablet surface. The first engagement fixture may be fixedly engaged with the first tablet, and may have a first protrusion defining a substantially cylindrical first exterior surface adapted to removably and securely engage with the substantially cylindrical first cavity.

20 Claims, 5 Drawing Sheets

(56) References Cited

U.S. PATENT DOCUMENTS

| | | | | |
|---|---|---|---|---|
| 2011/0233251 | A1 | 9/2011 | Doig | |
| 2012/0223548 | A1 | 9/2012 | Sharber et al. | |
| 2012/0292954 | A1 | 11/2012 | Chatwin | |
| 2013/0249256 | A1* | 9/2013 | Payne, Jr. ..... | A47C 7/50<br>297/188.14 |

FOREIGN PATENT DOCUMENTS

| | | |
|---|---|---|
| JP | 11-342 040 | 12/1999 |
| JP | 11-342 042 | 12/1999 |
| JP | 2011505921 | 3/2011 |

* cited by examiner

MODULAR FURNITURE

I. BACKGROUND

The present subject matter generally relates to methods and apparatuses concerning modular furniture. More specifically, the present subject matter is directed a chair with one or more modular components and more specifically relates to methods and apparatuses concerning a chair with a cup holder and modular tablet arm adapted for operational engagement therewith.

Some furniture items, such as chairs or camping chairs, are provided with one, or more than one, cup holder. Some furniture items, such as chairs, have a tablet arm attached, either for a right-handed person or a left-handed person.

It remains desirable to provide furniture that allows for an interchangeable cup holder and tablet arm wherein a tablet arm is modular to permit quick operational engagement and disengagement with an interchangeable cup holder on one or more regions of the furniture.

II. SUMMARY

In accordance with one aspect of the present subject matter, provided is a modular furniture apparatus comprising a chair, a first cup holder engaged with the chair, a first tablet, and a first engagement fixture. The first cup holder may define a substantially cylindrical first cavity having a substantially cylindrical first interior wall elongated along a first cylinder axis, the first interior wall bounded by an inward-facing first bottom end wall, and by an open aperture opposite the first bottom end wall along the first cylinder axis. The first tablet may have a first tablet surface, and a second tablet surface opposite said first tablet surface. The first engagement fixture may be fixedly engaged with the first tablet, and may have a first protrusion defining a substantially cylindrical first exterior surface adapted to removably and securely engage with the substantially cylindrical first cavity.

Still other benefits and advantages of the present subject matter will become apparent to those skilled in the art to which it pertains upon a reading and understanding of the following detailed specification.

III. BRIEF DESCRIPTION OF THE DRAWINGS

The present subject matter is described hereinafter with reference to the accompanying drawings.

IV. DETAILED DESCRIPTION

Figure 1:
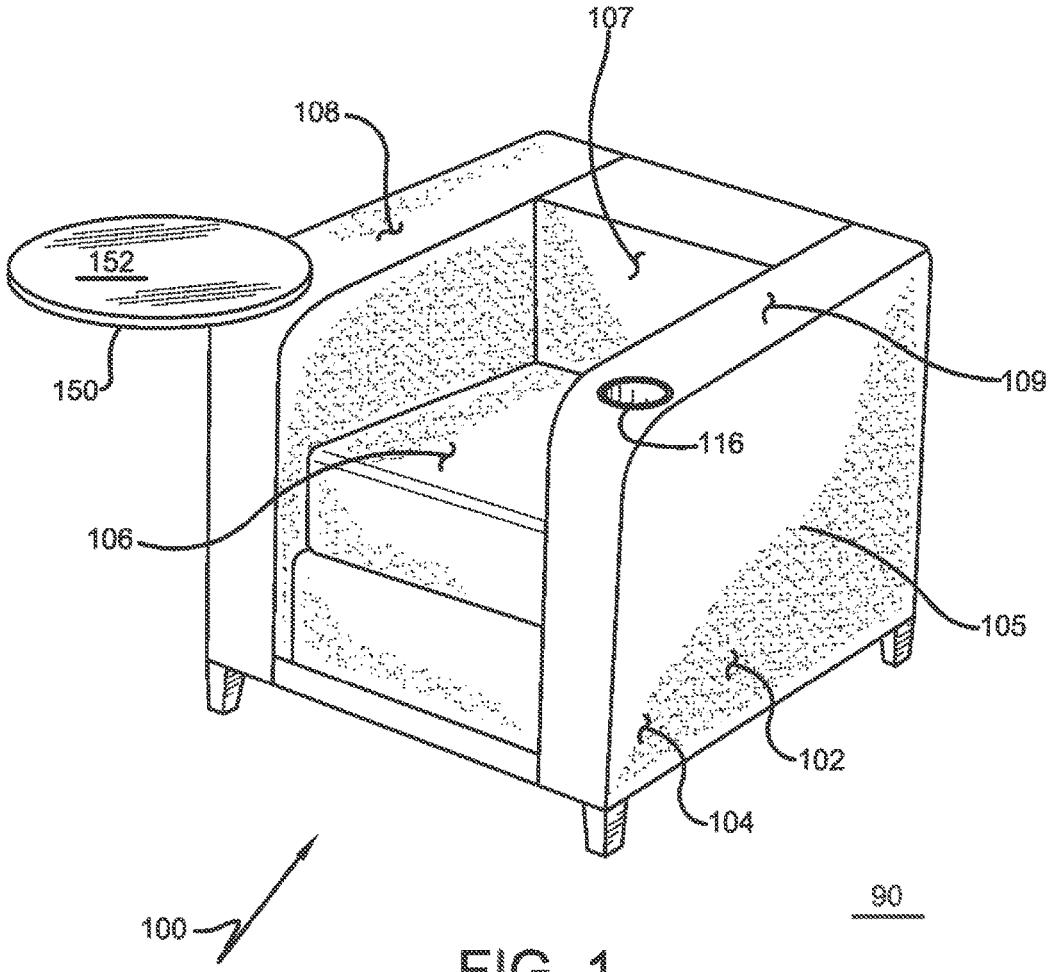
FIG. 1 is a perspective view of one embodiment of a modular furniture apparatus.
Figure 2:
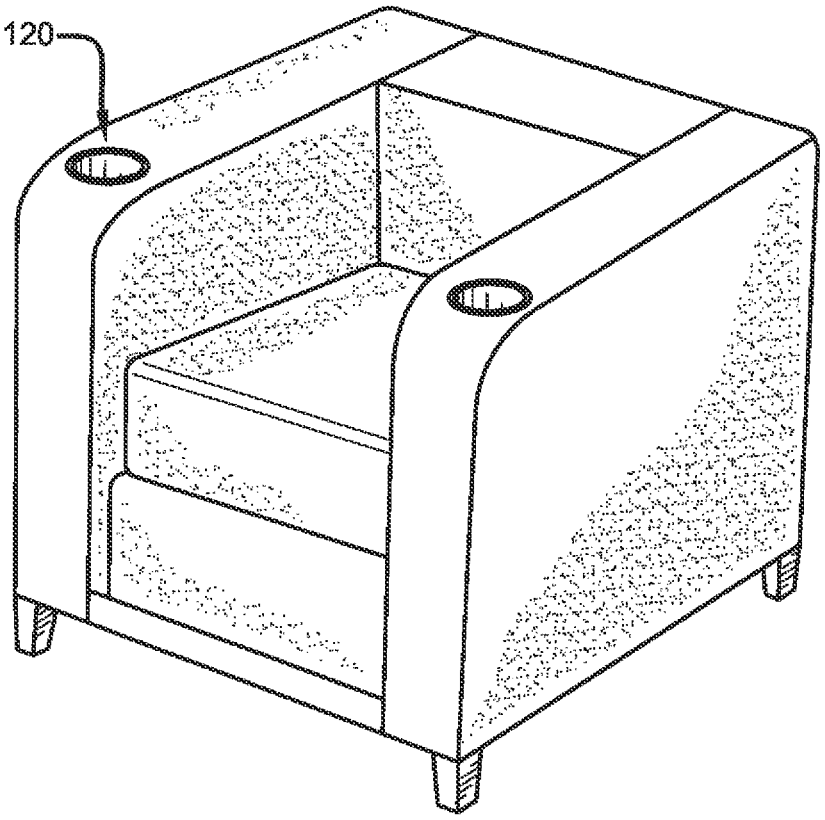
FIG. 2 is a perspective view of one embodiment of a modular furniture apparatus.
Figure 3:
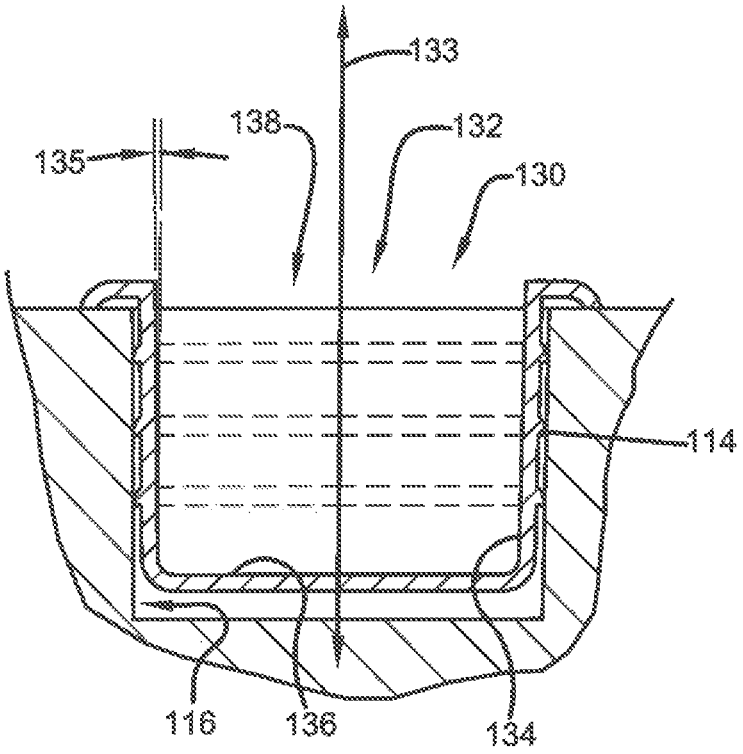
FIG. 3 is a sectional view of one embodiment of a cup holder of a modular furniture apparatus.
Figure 4:
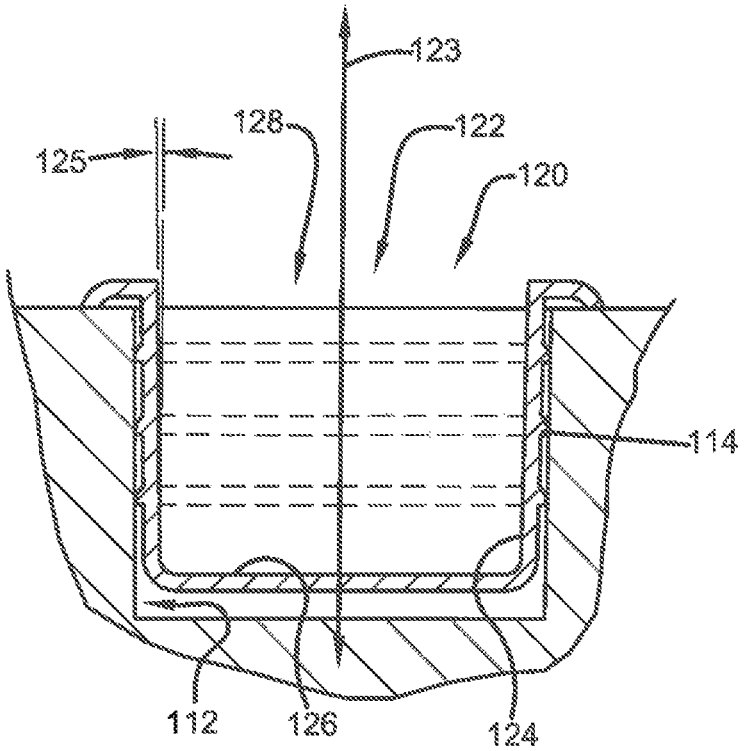
FIG. 4 is a sectional view of one embodiment of a cup holder of a modular furniture apparatus.
Figure 5:
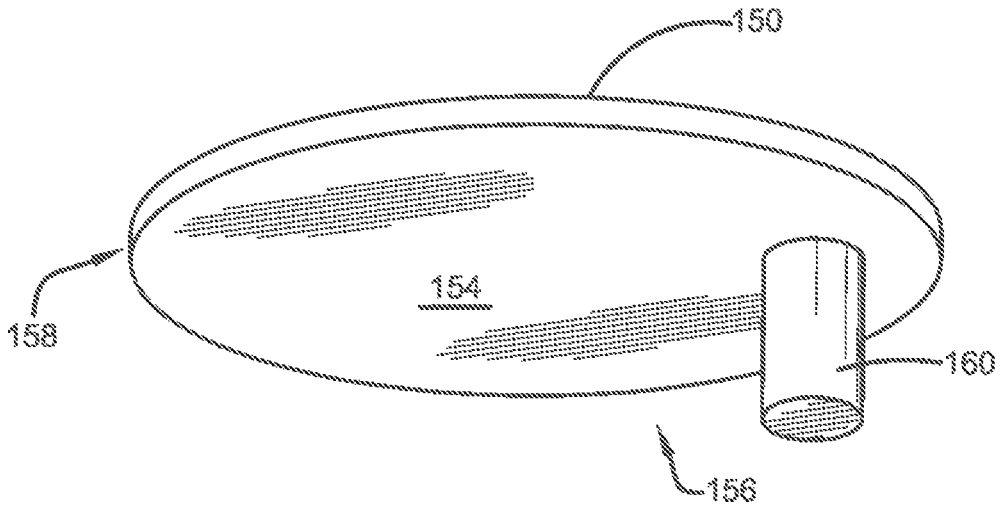
FIG. 5 is a bottom view of one embodiment of a first tablet of a modular furniture apparatus.
Figure 6:
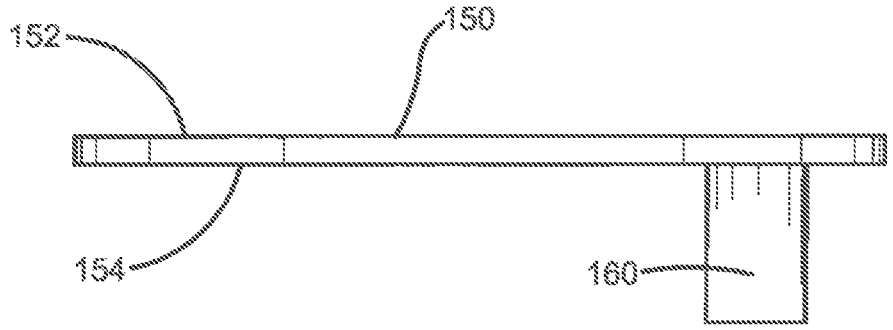
FIG. 6 is a side view of one embodiment of a first tablet of a modular furniture apparatus.

Referring now to the drawings wherein the showings are for purposes of illustrating the present subject matter only and not for purposes of limiting the same, and wherein like reference numerals are understood to refer to like components, provided is a modular furniture apparatus 100.

The modular furniture apparatus 100 is usable on a surface 90. Surface 90 may be, without limitation, a floor or other ground region. In some cases, modular furniture apparatus 100 may be usable on a surface 90 that is slightly inclined with respect to horizontal, but in other cases the surface 90 will be flat with no inclination with respect to horizontal.

The modular furniture apparatus 100 may comprise an article of furniture 102 such as, without limitation, a chair 104, sofa, or bench. The article of furniture 102, may comprise, without limitation, a seat 106, and one or more of a back support 107, a first arm 108, and a second arm 109. The article of furniture 102 may, optionally, be upholstered or covered, at least partially, with one or more kinds of cover material 105 to provide padding, decoration, or for the protection of the article of furniture 102 or an associated user. Without limitation, in some embodiments a cover material 105 may comprise, artificial leather, nylon, polyurethane, or cotton.

The modular furniture apparatus 100 may comprise a first cup holder 120. The first cup holder 120 may be engaged with the article of furniture 102 by any means chosen with good engineering judgment. In some examples, the first cup holder 120 is inserted into a mating cavity 112 formed within a portion of an article of furniture 102 such as, without limitation, in a first arm 108. Alternatively, a cup holder may be engaged with the article of furniture 102 by a bracket, a frame, or another structure. In some examples, the first cup holder 120 is engaged with the article of furniture 102 with one or more of mechanical threads, adhesive, a mechanical fastener 114, and an interference fit. In some examples, the mechanical fastener 114 may comprise one or more of a bolt, a pin, a nut, a clamp, a clip, and a spur. In some examples, the first cup holder 120 is integrally formed with the article of furniture 102.

The first cup holder 120 may be of any shape and size chosen with good engineering judgment. In some examples, the first cup holder 120 is defined by a first cavity 122 that his elongated to define an axis 123. In some examples, the first cavity 122 is defined by a geometry such that it has a cross-sectional shape and size transverse to axis 123 that is constant along the axis 123. In some examples, the first cavity 122 is defined by a geometry such that it has a cross-sectional shape and size transverse to axis 123 that is changes along the axis 123. In some examples, the first cavity 122 has a cross-section that is circular, square, or hexagonal. In some examples, the first cavity 122 is substantially cylindrical. A slight deviation from being cylindrical due to, without limitation, a slight draft angle 125 such as a draft angle in the range of 0.5 degree to 6 degrees, or a subset thereof, would still be substantially cylindrical for the present purposes.

In examples in which the first cavity 122 is substantially cylindrical, the first cavity 122 may comprise a substantially cylindrical first interior wall 124 elongated along a first cylinder axis 123. As noted above, the first interior wall 124 may have some draft angle to it in the range of 0.5 degree to 6 degrees such as, without limitation, in the range of 1 degree to 4 degrees. Where the first cavity 122 is substantially cylindrical, the first interior wall 124 may be bounded by an inward-facing first bottom end wall 126 and by an open aperture 128 opposite the first bottom end wall 126 along the first cylinder axis 123.

Similarly, the modular furniture apparatus 100 may comprise a second cup holder 130. The second cup holder 130 may be engaged with the article of furniture 102 by any means chosen with good engineering judgment. In some examples, the second cup holder 130 is inserted into a mating cavity 116 formed within a portion of an article of furniture 102 such as, without limitation, in a second arm 109. In some examples, the second cup holder 130 is engaged with the article of furniture 102 with one or more of mechanical threads, adhesive, a mechanical fastener 114, and an interference fit. In some examples, the mechanical fastener 114 may comprise one or more of a bolt, a pin, a nut, a clamp, a clip, and a spur. In some examples, the second cup holder 130 is integrally formed with the article of furniture 102.

The second cup holder 130 may be of any shape and size chosen with good engineering judgment. In some examples, the second cup holder 130 may have a geometry substantially identical to that of the first cup holder 120. In some examples, the second cup holder 130 is defined by a second cavity 132 that his elongated to define an axis 133. In some examples, the second cavity 132 is defined by a geometry such that it has a cross-sectional shape and size transverse to axis 133 that is constant along the axis 133. In some examples, the second cavity 132 is defined by a geometry such that it has a cross-sectional shape and size transverse to axis 133 that is changes along the axis 133. In some examples, the second cavity 132 has a cross-section that is circular, square, or hexagonal. In some examples, the second cavity 132 is substantially cylindrical. A slight deviation from being cylindrical due to, without limitation, a slight draft angle 135 such as a draft angle in the range of 0.5 degree to 6 degrees, or a subset thereof, would still be substantially cylindrical for the present purposes.

In examples in which the second cavity 132 is substantially cylindrical, the second cavity 132 may comprise a substantially cylindrical second interior wall 134 elongated along a second cylinder axis 133. As noted above, the second interior wall 134 may have some draft angle to it in the range of 0.5 degree to 6 degrees such as, without limitation, in the range of 1 degree to 4 degrees. Where the second cavity 132 is substantially cylindrical, the second interior wall 134 may be bounded by an inward-facing second bottom end wall 136 and by an open aperture 138 opposite the second bottom end wall 136 along the first cylinder axis 123.

The modular furniture apparatus 100 may comprise a first tablet 150. The first tablet 150 may have a first tablet surface 152 and a second tablet surface 154 opposite the first tablet surface 152. In some examples, the first tablet 150 may be a desk, an eating surface, or a work surface.

The first tablet 150 may be selectably and removably engaged with the article of furniture 102 through a first engagement fixture 160. The first engagement fixture 160 may be fixedly engaged with the first tablet 150 by any means chosen with good engineering judgment. In some examples, the first engagement fixture 160 is fixedly engaged to the second table surface 154 by a mechanical fastener or an adhesive. In some examples, the first engagement fixture 160 is integrally formed with the first tablet 150.

The first engagement fixture 160 has a first protrusion 162 defining a first exterior surface 164. In some examples, the first exterior surface 164 is adapted to removable and securely engage with the first cavity 122. In some embodiments, the first exterior surface 164 is adapted to removable and securely engage with the second cavity 132. In some examples, the first exterior surface 164 is adapted to removable and securely engage with both the first cavity 122 and the second cavity 132 in the alternative. In some examples, the first exterior surface 164 is of substantially the same shape as both the first cavity 122 and the second cavity 132 and is slightly smaller than both the first cavity 122 and the second cavity 132 such that it can be securely and removable nested within the either the first cavity 122 or the second cavity 132. In some examples, the first tablet surface 152 is substantially horizontal when the first exterior surface 164 is engaged with the first cavity 122 or the second cavity 132. In some examples, the tablet 150 is free to rotate about the first cylinder axis 123 when the first exterior surface 164 is engaged with the first cavity 122. In some examples, the tablet 150 is free to rotate about the second cylinder axis 133 when the first exterior surface 164 is engaged with the second cavity 132. In some examples, the first tablet 150 is elongated to define a first tablet end 156 and a second tablet end 158 opposite the first tablet end 156. In some examples, the first engagement fixture 160 is engaged with first tablet 150 at a location closer to the first tablet end 156 than to the second tablet end 158.

In some examples, the cup holders are oriented such that, when the modular furniture apparatus is positioned upright on a horizontal surface 90, the first cylinder axis 123 and the first cylinder axis 133 are substantially vertical.

An associated user may engage the first tablet 150 with or disengage the first tablet 150 from either the first cup holder 114 or the second cup holder 116 by selectably engaging the first exterior surface 164 with either the first cavity 122 or the second cavity 132. An associated user may switch the engagement of the first tablet 150 from the first cup holder 114 to the second cup holder 116 or vice versa.

Further examples consistent with the present subject matter are set out in the following numbered clauses.

Clause 1. A modular furniture apparatus comprising a chair, a first cup holder engaged with the chair, the first cup holder being defined by a substantially cylindrical first cavity having a substantially cylindrical first interior wall elongated along a first cylinder axis, the first interior wall bounded, by an inward-facing first bottom end wall, and by an open aperture opposite the first bottom end wall along the first cylinder axis, a first tablet having a first tablet surface, and a second tablet surface opposite said first tablet surface, a first engagement fixture, the first engagement fixture being fixedly engaged with the first tablet, and having a first protrusion defining a substantially cylindrical first exterior surface adapted to removably and securely engage with the substantially cylindrical first cavity.

Clause 2. The modular furniture apparatus of claim 1, wherein the substantially cylindrical first interior wall has some non-zero draft angle.

Clause 3. The modular furniture apparatus of claim 1 or 2, further comprising a second cup holder engaged with the chair, the second cup holder being defined by a substantially cylindrical second cavity having a substantially cylindrical second interior wall elongated along a second cylinder axis, the second interior wall bounded, by an inward-facing second bottom end wall and by an open aperture opposite the second bottom end wall along the second cylinder axis.

Clause 4. The modular furniture apparatus of claim 3, wherein the substantially cylindrical second interior wall has some non-zero draft angle.

Clause 5. The modular furniture apparatus of claims 1-4, wherein the first exterior surface is adapted to removably and securely engage with both the first cavity and the second cavity in the alternative.

Clause 6. The modular furniture apparatus of claims 3-5, wherein the first cup holder and the second cup holder are of identical geometry.

Clause 7. The modular furniture apparatus of claims 3-6, wherein the first cylinder axis is substantially vertical, and the second cylinder axis is substantially vertical.

Clause 8. The modular furniture apparatus of claims 3-7, wherein the first tablet surface is substantially horizontal when the first exterior surface is engaged with the first cavity or the second cavity.

Clause 9. The modular furniture apparatus of claims 1-8, wherein the tablet is free to rotate about the first cylinder axis when the first exterior surface is engaged with the first cavity.

Clause 10. The modular furniture apparatus of claims 1-9, wherein the first tablet is elongated to define a first tablet end and a second tablet end opposite the first tablet end, and the first engagement fixture is engaged with first tablet at a location closer to the first tablet end than to the second tablet end.

Clause 11. A method of using a modular furniture apparatus comprising providing a modular furniture apparatus having a chair, a first cup holder engaged with the chair, the first cup holder being defined by a substantially cylindrical first cavity having a substantially cylindrical first interior wall elongated along a first cylinder axis, the first interior wall bounded, by an inward-facing first bottom end wall, and by an open aperture opposite the first bottom end wall along the first cylinder axis, a first tablet having a first tablet surface, and a second tablet surface opposite said first tablet surface, a first engagement fixture, the first engagement fixture being fixedly engaged with the first tablet, and having a first protrusion defining a substantially cylindrical first exterior surface adapted to removably and securely engage with the substantially cylindrical first cavity; and either engaging the first exterior surface with the first cavity, or disengaging the first exterior surface from the first cavity.

Clause 12. The method of using a modular furniture apparatus of claim 11, further comprising a second cup holder engaged with the chair, the second cup holder being defined by a second substantially cylindrical cavity having a substantially cylindrical second interior wall elongated along a second cylinder axis, the second interior wall bounded by an upward-facing second bottom end wall and by an open aperture opposite the second bottom end wall along the second cylinder axis.

Clause 13. The method of using a modular furniture apparatus of claim 12, wherein the substantially cylindrical first interior wall has some non-zero draft angle, and wherein the substantially cylindrical second interior wall has some non-zero draft angle.

Clause 14. The method of using a modular furniture apparatus of claim 12 or 13, wherein the first cup holder and the second cup holder are of identical geometry; and wherein the first exterior surface is adapted to removably and securely engage with both the first cavity and the second cavity in the alternative.

Clause 15. The method of using a modular furniture apparatus of claims 12-14, further comprising either, switching engagement of the first exterior surface from the first cavity to the second cavity or switching engagement of the first exterior surface from the second cavity to the first cavity.

Clause 16. The method of using a modular furniture apparatus of claims 12-14, wherein the first cylinder axis is substantially vertical, and the second cylinder axis is substantially vertical.

Clause 17. The method of using a modular furniture apparatus of claims 12-16, wherein the first tablet surface is substantially horizontal when the first exterior surface is engaged with the first cavity or the second cavity.

Clause 18. The method of using a modular furniture apparatus of claims 12-17, wherein the first tablet is elongated to define a first tablet end and a second tablet end opposite the first tablet end, and the first engagement fixture is engaged with first tablet at a location closer to the first tablet end than to the second tablet end.

Clause 19. The method of using a modular furniture apparatus of claims 12-18, further comprising either rotating the tablet about the first cylinder axis when the first exterior surface of the first protrusion is engaged with the substantially cylindrical first cavity; or rotating the tablet about the second cylinder axis when the first exterior surface of the first protrusion is engaged with the substantially cylindrical second cavity; and either, switching engagement of the first exterior surface from the first cavity to the second cavity; or switching engagement of the first exterior surface from the second cavity to the first cavity.

Clause 20. A modular furniture apparatus comprising a chair, a first cup holder engaged with the chair, the first cup holder being defined by a substantially cylindrical first cavity having a substantially cylindrical first interior wall elongated along a substantially vertical first cylinder axis, the first interior wall having a draft angle in the range of 1 degree to 4 degrees, the first interior wall bounded, by an inward-facing first bottom end wall, and by an open aperture opposite the first bottom end wall along the first cylinder axis, a second cup holder engaged with the chair, the second cup holder having geometry substantially identical to that of the first cup holder, the second cup holder being defined by a substantially cylindrical second cavity having a substantially cylindrical second interior wall elongated along a substantially vertical second cylinder axis, the second interior wall having a draft angle in the range of 1 degree to 4 degrees, the second interior wall bounded by an inward-facing second bottom end wall and by an open aperture opposite the second bottom end wall along the second cylinder axis, a first tablet having a first tablet surface, and a second tablet surface opposite said first tablet surface, a first engagement fixture, the first engagement fixture being fixedly engaged with the first tablet, and having a first protrusion defining a substantially cylindrical first exterior surface adapted to removably and securely engage with both the first cavity and the second cavity in the alternative, wherein the first tablet surface is substantially horizontal when the first exterior surface is engaged with the first cavity or the second cavity, wherein the tablet is free to rotate about the first cylinder axis when the first exterior surface is engaged with the first cavity, wherein the tablet is free to rotate about the second cylinder axis when the first exterior surface is engaged with the second cavity, and wherein the first tablet is elongated to define a first tablet end and a second tablet end opposite the first tablet end, and the first engagement fixture is engaged with first tablet at a location closer to the first tablet end than to the second tablet end.

Various examples have been described above for providing a modular furniture item. Those skilled in the art will understand, however, that changes and modifications may be made to those examples without departing from the spirit and scope of the following claims and their equivalents.

I claim:

1. A modular furniture apparatus comprising:

a chair;

a first cup holder engaged with the chair, the first cup holder being defined by a substantially cylindrical first cavity having a substantially cylindrical first interior wall elongated along a first cylinder axis, the first interior wall bounded, by an inward-facing first bottom end wall, and by an open aperture opposite the first bottom end wall along the first cylinder axis;

a first tablet having a first tablet surface, and a second tablet surface opposite said first tablet surface;

a first engagement fixture, the first engagement fixture being fixedly engaged with the first tablet, and having a first protrusion defining a substantially cylindrical first exterior surface adapted to removably and securely engage with the substantially cylindrical first cavity;

wherein the first cup holder is capable of holding a cup in the substantially cylindrical first cavity when the substantially cylindrical first cavity is not securely engaged with the first engagement fixture.

2. The modular furniture apparatus of claim 1, wherein the substantially cylindrical first interior wall has some non-zero draft angle.

3. The modular furniture apparatus of claim 2, further comprising:

a second cup holder engaged with the chair, the second cup holder being defined by a substantially cylindrical second cavity having a substantially cylindrical second interior wall elongated along a second cylinder axis, the second interior wall bounded;

by an inward-facing second bottom end wall; and by an open aperture opposite the second bottom end wall along the second cylinder axis.

4. The modular furniture apparatus of claim 3, wherein the substantially cylindrical second interior wall has some non-zero draft angle.

5. The modular furniture apparatus of claim 4, wherein the first exterior surface is adapted to removably and securely engage with both the first cavity and the second cavity in the alternative.

6. The modular furniture apparatus of claim 5, wherein the first cup holder and the second cup holder are of identical geometry.

7. The modular furniture apparatus of claim 6, wherein the first cylinder axis is substantially vertical, and the second cylinder axis is substantially vertical.

8. The modular furniture apparatus of claim 7, wherein the first tablet surface is substantially horizontal when the first exterior surface is engaged with the first cavity or the second cavity.

9. The modular furniture apparatus of claim 8, wherein the tablet is free to rotate about the first cylinder axis when the first exterior surface is engaged with the first cavity.

10. The modular furniture apparatus of claim 9, wherein the first tablet is elongated to define a first tablet end and a second tablet end opposite the first tablet end, and the first engagement fixture is engaged with first tablet at a location closer to the first tablet end than to the second tablet end.

11. A method of using a modular furniture apparatus comprising:

providing a modular furniture apparatus having a chair, a first cup holder engaged with the chair, the first cup holder being defined by a substantially cylindrical first cavity having a substantially cylindrical first interior wall elongated along a first cylinder axis, the first interior wall bounded, by an inward-facing first bottom end wall, and by an open aperture opposite the first bottom end wall along the first cylinder axis, a first tablet having a first tablet surface, and a second tablet surface opposite said first tablet surface, a first engagement fixture, the first engagement fixture being fixedly engaged with the first tablet, and having a first protrusion defining a substantially cylindrical first exterior surface adapted to removably and securely engage with the substantially cylindrical first cavity; and either engaging the first exterior surface with the first cavity, or disengaging the first exterior surface from the first cavity;

wherein the first cup holder is capable of holding a cup in the substantially cylindrical first cavity when the substantially cylindrical first cavity is not securely engaged with the first engagement fixture.

12. The method of using a modular furniture apparatus of claim 11, further comprising:

a second cup holder engaged with the chair, the second cup holder being defined by a second substantially cylindrical cavity having a substantially cylindrical second interior wall elongated along a second cylinder axis, the second interior wall bounded;

by an upward-facing second bottom end wall; and by an open aperture opposite the second bottom end wall along the second cylinder axis.

13. The method of using a modular furniture apparatus of claim 12, wherein the substantially cylindrical first interior wall has some non-zero draft angle; and wherein the substantially cylindrical second interior wall has some non-zero draft angle.

14. The method of using a modular furniture apparatus of claim 13, wherein the first cup holder and the second cup holder are of identical geometry; and wherein the first exterior surface is adapted to removably and securely engage with both the first cavity and the second cavity in the alternative.

15. The method of using a modular furniture apparatus of claim 14, further comprising:

either, switching engagement of the first exterior surface from the first cavity to the second cavity; or switching engagement of the first exterior surface from the second cavity to the first cavity.

16. The method of using a modular furniture apparatus of claim 14, wherein the first cylinder axis is substantially vertical, and the second cylinder axis is substantially vertical.

17. The method of using a modular furniture apparatus of claim 16, wherein the first tablet surface is substantially horizontal when the first exterior surface is engaged with the first cavity or the second cavity.

18. The method of using a modular furniture apparatus of claim 17, wherein the first tablet is elongated to define a first tablet end and a second tablet end opposite the first tablet end, and the first engagement fixture is engaged with first tablet at a location closer to the first tablet end than to the second tablet end.

19. The method of using a modular furniture apparatus of claim 18, further comprising:

either rotating the tablet about the first cylinder axis when the first exterior surface of the first protrusion is engaged with the substantially cylindrical first cavity; or rotating the tablet about the second cylinder axis when the first exterior surface of the first protrusion is engaged with the substantially cylindrical second cavity; and either, switching engagement of the first exterior surface from the first cavity to the second cavity; or switching engagement of the first exterior surface from the second cavity to the first cavity.

20. A modular furniture apparatus comprising:

a chair;

a first cup holder engaged with the chair, the first cup holder being defined by a substantially cylindrical first cavity having a substantially cylindrical first interior wall elongated along a substantially vertical first cylinder axis, the first interior wall having a draft angle in the range of 1 degree to 4 degrees, the first interior wall bounded, by an inward-facing first bottom end wall, and by an open aperture opposite the first bottom end wall along the first cylinder axis;

a second cup holder engaged with the chair, the second cup holder having geometry substantially identical to that of the first cup holder, the second cup holder being defined by a substantially cylindrical second cavity having a substantially cylindrical second interior wall elongated along a substantially vertical second cylinder axis, the second interior wall having a draft angle in the range of 1 degree to 4 degrees, the second interior wall bounded;

by an inward-facing second bottom end wall; and by an open aperture opposite the second bottom end wall along the second cylinder axis, a first tablet having a first tablet surface, and a second tablet surface opposite said first tablet surface;

a first engagement fixture, the first engagement fixture being fixedly engaged with the first tablet, and having a first protrusion defining a substantially cylindrical first exterior surface adapted to removably and securely engage with both the first cavity and the second cavity in the alternative;

wherein the first tablet surface is substantially horizontal when the first exterior surface is engaged with the first cavity or the second cavity;

wherein the tablet is free to rotate about the first cylinder axis when the first exterior surface is engaged with the first cavity;

wherein the tablet is free to rotate about the second cylinder axis when the first exterior surface is engaged with the second cavity; and wherein the first tablet is elongated to define a first tablet end and a second tablet end opposite the first tablet end;

the first engagement fixture is engaged with first tablet at a location closer to the first tablet end than to the second tablet end; and the first cup holder is capable of holding a cup in the substantially cylindrical first cavity when the substantially cylindrical first cavity is not securely engaged with the first engagement fixture.

* * * * *